US006010549A

United States Patent [19]

Higashi et al.

[11] Patent Number: 6,010,549

[45] Date of Patent: Jan. 4, 2000

[54] SPARK ARRESTER OF MUFFLER

[75] Inventors: Kenji Higashi; Shinji Katayama; Daisuke Arai, all of Wako, Japan

[73] Assignee: Honda Giken Kogyo Kabushiki Kaisha, Tokyo, Japan

[21] Appl. No.: 09/083,986

[22] Filed: May 22, 1998

[30] Foreign Application Priority Data

Jun. 23, 1997 [JP] Japan ..... 9-166297

[51] Int. Cl.[7] ..... F01N 3/06; B01D 50/00

[52] U.S. Cl. ..... 55/385.3; 55/414; 55/418; 55/503; 55/505; 55/DIG. 20

[58] Field of Search ..... 55/385.3, DIG. 20, 55/414, 418, 422, 419, 505, 503; 96/380, 388; 60/311, 324; 181/272, 231

[56] References Cited

U.S. PATENT DOCUMENTS

| | | | |
|---|---|---|---|
| 865,189 | 9/1907 | Lamb | 55/DIG. 20 |
| 1,532,473 | 4/1925 | Byrne | 60/311 |
| 2,524,588 | 10/1950 | Bechtel | 55/505 |
| 2,732,026 | 1/1956 | Folts | 55/503 |
| 3,677,364 | 7/1972 | Pawlina | 96/388 |
| 3,884,655 | 5/1975 | Coop | 96/380 |
| 5,177,962 | 1/1993 | Hall et al. | 55/DIG. 20 |

FOREIGN PATENT DOCUMENTS 60-33290 10/1985 Japan .

*Primary Examiner*—David A. Simmons
*Assistant Examiner*—Minh-Chau T. Pham
*Attorney, Agent, or Firm*—Merchant & Gould P.C.

[57] ABSTRACT

A spark arrester includes a buffer plate against which exhaust gases discharged from the outlet end of a tail pipe strike directly. Upon impingement on the buffer plate, the exhaust gases become turbulent or agitated whereupon temperature distribution of the exhaust gases is made uniform. The buffer plate has a plurality of through-holes arranged to allow passage of the exhaust gases after the exhaust gases impinge against the buffer plate. After passing through the through-holes, the exhaust gases flow through a wire screen during which time sparks in the exhaust gases are caught by the wire screen. The exhaust gases are then guided downstream along a guide tube and finally released from an outlet end of the guide tube. A stream of exhaust gases discharged from the guide tube has only a limited length of high-temperature zone.

12 Claims, 5 Drawing Sheets

SPARK ARRESTER OF MUFFLER

BACKGROUND OF THE INVENTION

1. Field of the Invention

The present invention relates to a spark arrester of an internal combustion engine for portable working machines.

2. Description of the Related Art

A spark arresting device or arrester used in an engine-powered portable working machine, such as a weeding machine or a chain saw, is disclosed in, for example, Japanese Utility Model Publication No. SHO 60-33290. The disclosed spark arrester has a wire screen attached to the outlet end of a tail pipe for arresting or catching sparks in exhaust gases to thereby prevent the sparks from escaping into the atmosphere.

FIG. 6 of the accompanying drawings shows a spark arrester using a similar wire screen. As shown in FIG. 6, the spark arrester 100 is attached to a tail pipe 102 of a muffler 101 and includes a stay 104 fitted around the tail pipe 102, a flared pipe 105 attached by clenching to the stay 104, and a wire screen 106 attached by clenching to a wide outer end 105*a* of the flared pipe 105.

Exhaust gases from an internal combustion engine 107 pass successively through a first expansion chamber 108 and a second expansion chamber 109 of the muffler 101 and flow into the tail pipe 102. Then, sparks in the exhaust gases are arrested or caught by the wire screen 106 and, thereafter, the exhaust gases are released into the atmosphere.

The exhaust gases, as they are discharged from the tail pipe 102 through the wire screen 106 into the atmosphere, form a stream of hot gases having a certain temperature distribution which is composed of a relatively high-temperature inner area or section S1 (indicated by hatching for clarity) and a relatively low-temperature outer area or section S2. The inner section S1 of the hot gas stream flowing out from the wire screen 106 has a length L1 smaller than the length L2 of the outer section S2.

The length of such hot exhaust gas stream including the two temperature sections S1 and S2 should preferably be minimized because a longer hot exhaust gas stream is likely to affect or damage the user and surroundings of an engine-powered working machine, such as a chain saw, on which the spark arrester is attached.

SUMMARY OF THE INVENTION

A spark arrester of the present invention, which is attachable to an outlet end portion of a tail pipe of a muffler, includes a buffer plate having a plurality of through-holes arranged to allow exhaust gases discharged from an outlet end of the tail pipe to pass through said through-holes after the exhaust gases impinge against said buffer plate, and a wire screen for catching sparks in the exhaust gases.

The buffer plate preferably has a circular central wall portion having a diameter at least equal to an inside diameter of the outlet end portion of the tail pipe and arranged in confrontation with the outlet end of the tail pipe to ensure that the exhaust gases discharged from the outlet end of the tail pipe directly impinge against the central wall portion. Upon impingement on the central wall portion, the exhaust gases become turbulent or agitated with the result that temperature distribution of the exhaust gases is made uniform and has no free from a local high-temperature area.

The through-holes in the buffer plate are preferably arranged along an outer edge portion of said buffer plate. Additionally, the through-holes preferably have a total area which is equal to or greater than an area of the outlet end of the tail pipe.

In one preferred embodiment of the present invention, the buffer plate is disposed upstream of the wire screen when viewed from a direction of flow of the exhaust gases. As an alternative, the buffer plate may be disposed downstream of the wire screen.

The spark arrester may further include a guide tube for guiding and releasing the exhaust gases into the atmosphere. In the preferred embodiment, the guide tube is disposed downstream of the wire screen.

The buffer plate makes the exhaust gases to have a uniform temperature distribution. The exhaust gases with uniform temperature distribution are finally released from an outlet end of the guide tube. In this instance, the exhaust gases generate retention turbulent flows or swirls which take in cool atmospheric air and thus cool the hot exhaust gases rapidly as they are released from the guide tube. A stream of hot exhaust gases flowing out from the guide tube has only a limited length of high-temperature zone.

The above and other features and advantages of the present invention will become manifest to these versed in the art upon making reference to the detailed description and the accompanying sheets of drawings in which a preferred structural embodiment incorporating the principles of the invention is shown by way of illustrative examples.

DETAILED DESCRIPTION OF THE PREFERRED EMBODIMENT

Figure 1:
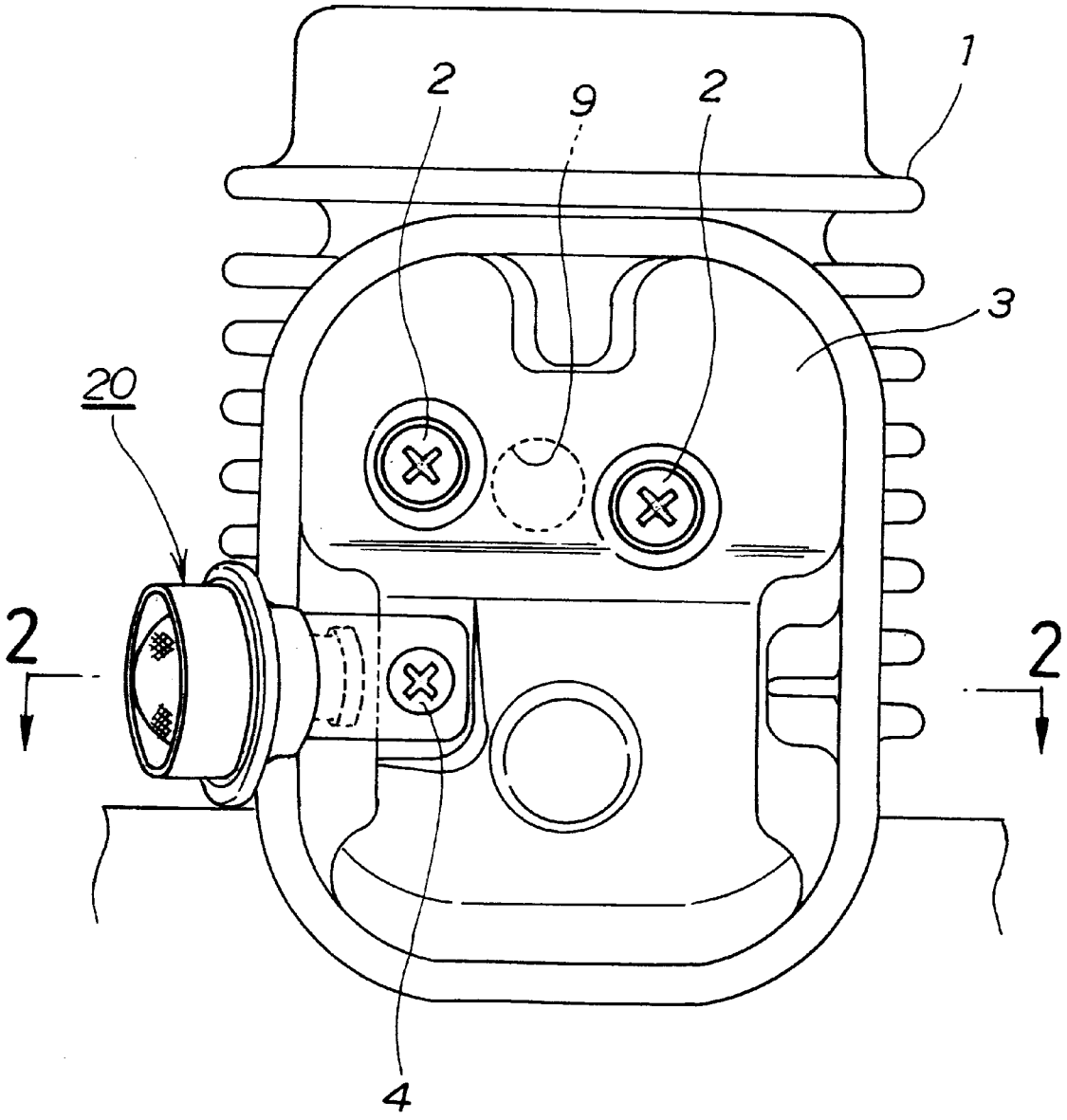
FIG. 1 is a front elevational view of a muffler having a spark arrester according to the present invention.

FIG. 1 diagrammatically shows an engine unit equipped with a spark arrester embodying the present invention. As shown in this figure, the engine unit generally comprises a small-sized general purpose internal combustion engine 1, a box-shaped muffler 3 attached by a pair of screws 2, 2 to a body of the engine 1, and a spark arrester 20 attached to an outlet end of the muffler 3 by means of a screw 4.

Figure 2:
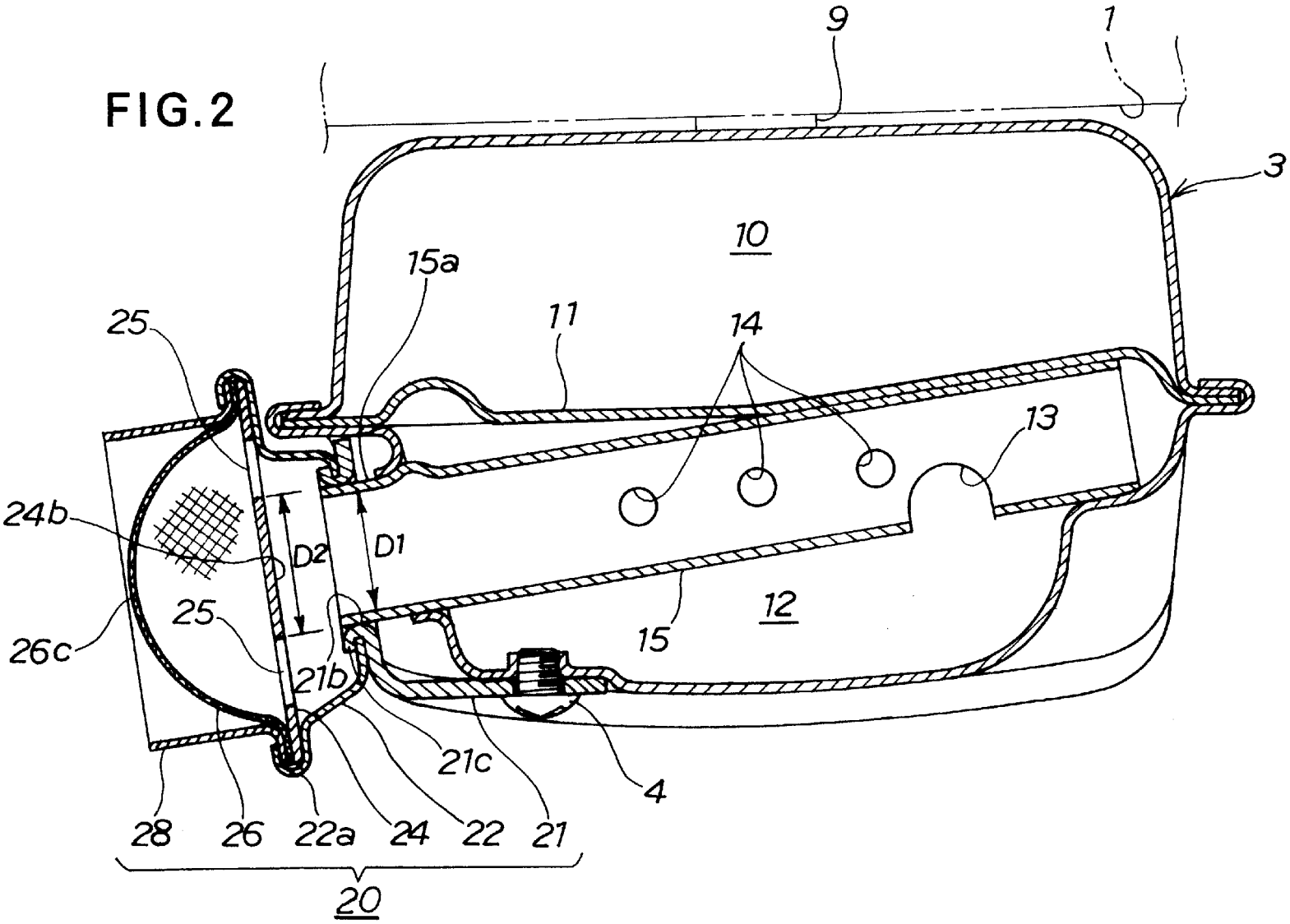
FIG. 2 is a cross-sectional view taken along line 2—2 of FIG. 1.

As shown in FIG. 2, the muffler 3 includes a connecting pipe 9 communicating with a cylinder (not shown) of the engine 1, a first expansion chamber 10 communicating with the connecting pipe 9, a second expansion chamber 12 communicating with the first expansion chamber 10 via an opening (not shown) in a partition wall 11, and a tail pipe 15 communicating with the second expansion chamber 12 via a large-diameter opening 13 and a plurality (three in the illustrated embodiment) of small-diameter openings or perforations 14. The tail pipe 15 is in the shape of a circular cylinder and has an inside diameter D1.

The spark arrester 20 includes a stay 21 fitted around an outlet end portion 15*a* of the tail pipe 15 and attached by the screw 4 to a body of the muffler 3, a flared tube 22 attached by clenching to the stay 21, a buffer plate 24 attached by clenching to a large-diameter outer end portion 22*a* of the flared tube 22, a wire screen 26, and a guide tube 28 attached by clenching to the outer end portion 22*a* of the flared tube 22 together with the wire screen 26 and the buffer plate 24. The the spark arrester 20 can readily be detached from the muffler 3 by removing the screw 4. This enables the wire screen 26 to be cleaned up by removing a carbon layer deposited on the inside surface of the wire screen 26.

Figure 3:
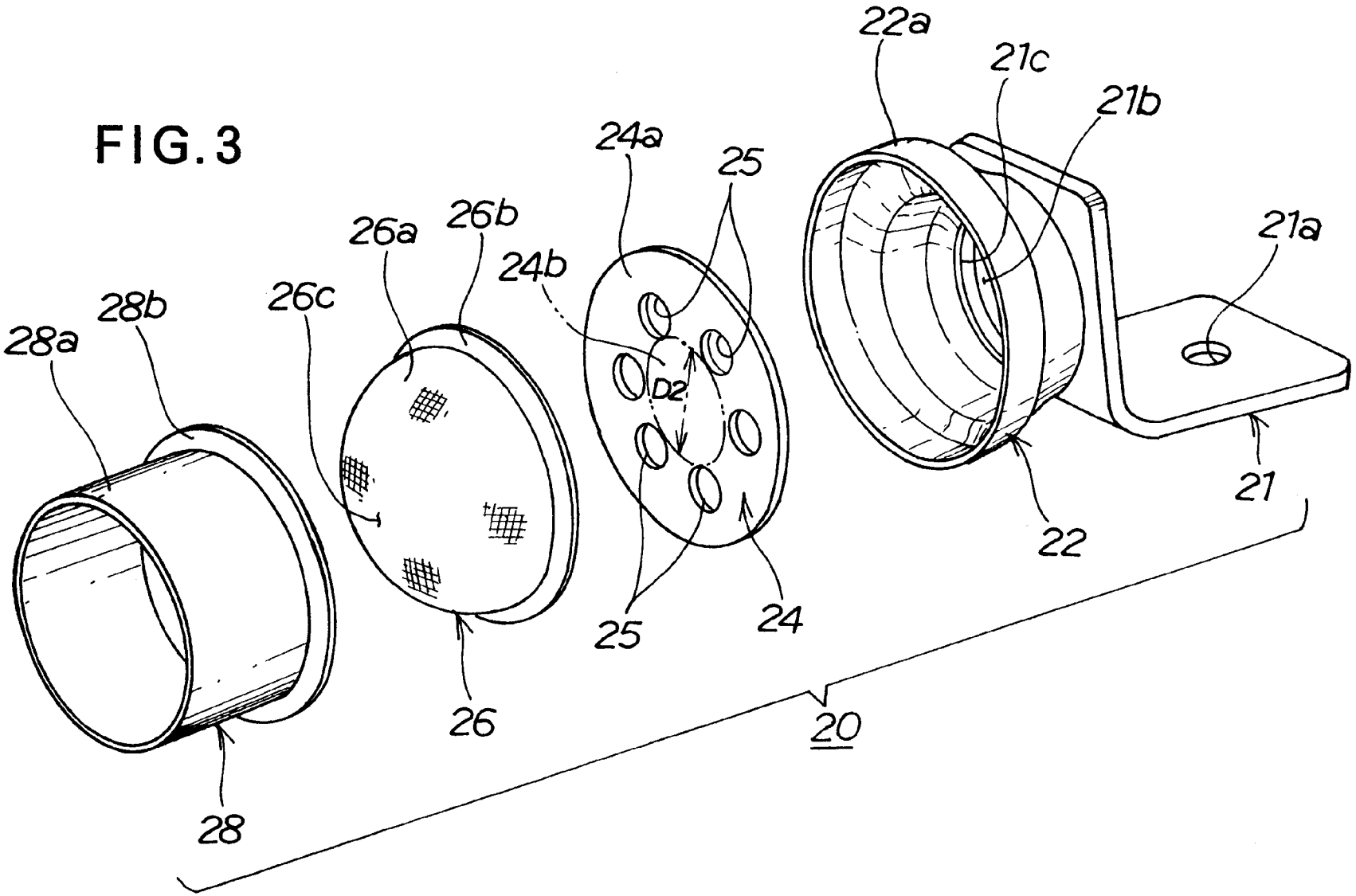
FIG. 3 is an exploded perspective view of the spark arrester shown in FIG. 2.

As shown in FIG. 3, the stay 21 is a generally L-shaped member having a horizontal arm in which a vertical screw hole 21*a* is formed for the passage therethrough of the screw 4 (FIG. 2), and a vertical arm in which a horizontal retaining hole 21*b* is formed for interference fit with the outlet end portion 15*a* (FIG. 2) of the tail pipe 15. The retaining hole 21*b* has a flange 21*c* curled or folded in a radial outward direction to firmly grip a small-diameter inner end portion of the flared tube 22.

The flared tube 22 has a hat-like shape, and the large-diameter outer end portion 22*a* is bent or folded radially and inwardly to firmly grip an outer edge 24*a* of the buffer plate 24, an annular flange 26*b* of the wire screen 26, and an annular flange 28*b* of the guide tube 28, as shown in FIG. 2. The outer end portion 22*a* shown in FIG. 3 is in a condition before it is clenched with the buffer plate 24, the wire screen 26 and the guide tube 28.

The buffer plate 24 is a circular disk and has a plurality of circular openings or through-holes 25 arranged at equal angular intervals along the outer edge 24*a* of the buffer plate 24 for the passage therethrough of exhaust gases. The through-holes 25 are located closer to the outer edge 24*a* than to a center of the buffer plate 24. In order to allow the exhaust gases to pass smoothly through the through-holes 25, the through-holes 25 have a total area (the sum of areas of the respective through-holes 25) which is equal to or greater than an area of a flow passage defined in the tail pipe 15 (FIG. 2). The tail pipe 15 has an inside diameter D1.

The through-holes 25 are located outwardly of a non-perforated, solid circular central wall portion 24*b* of the buffer plate 24. The circular central wall portion 24*b* indicated by a two-dot and dash line has an outside diameter D2 which is equal to or greater than the inside diameter D1 (FIG. 2) of the tail pipe 15 to ensure that the exhaust gases discharged from the outlet end portion 15*a* (FIG. 2) of the tail pipe 15 are allowed to pass through the through-holes 25 after they strike or impinge against the central wall portion 24*b* of the buffer plate 24.

The wire screen 26 is a screen member having a mesh size of, for example, 30 (i.e., a screen with 30 open spaces per linear inch) and has a hemispherical or dome-shaped arresting portion 26*a* projecting in a direction of flow of the exhaust gases (downstream of the tail pipe 15), and the annular flange 26*b* extending in a radial outward direction from an outer edge of the dome-shaped arresting portion 26*a*.

The guide tube 28 includes a circular cylindrical body 28*a* covering or housing the wire screen 26, and the annular flange 28*b* formed at an inner end of the cylindrical body 28*a*. The cylindrical body 28*a* of the guide tube 28 has a length which is equal to or slightly greater than the height of the dome-shaped arresting portion 26*a* of the wire screen 26 (which is equal to a distance between a top 26*c* of the dome-shaped arresting portion 26*a* and the annular flange 26*b*).

Figure 4:
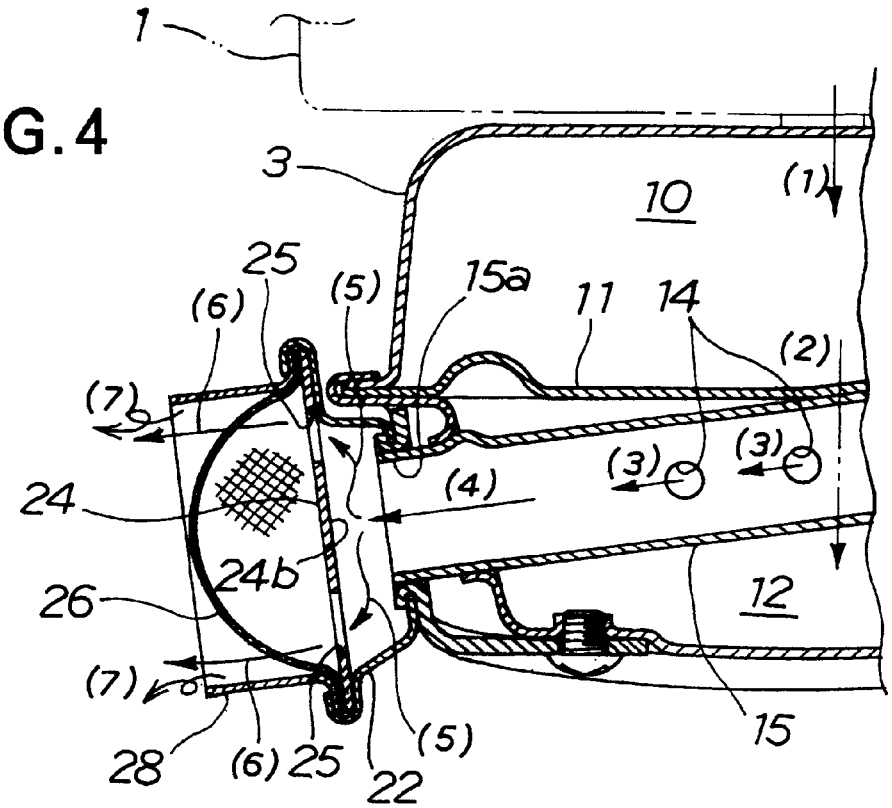
FIG. 4 is a fragmentary cross-sectional view showing the operation of the spark arrester taken in conjunction with the flow of exhaust gases.

Operation of the spark arrester 20 of the foregoing construction will be described with reference to FIGS. 4 and 5.

As shown in FIG. 1, exhaust gases discharged from the small-sized general purpose internal combustion engine 1 first enter the first expansion chamber 10 of the muffler 3, as indicated by the arrow (1), then flow into the second expansion chamber 12 through the opening (not shown) in the partition wall 11, as indicated by the arrow (2). The exhaust gases introduced into the second expansion chamber 12 subsequently flow into the tail pipe 15 through the perforations 14 in the tail pipe 15, as indicated by the arrows (3).

The exhaust gases as they flow downstream along the tail pipe 15 have a temperature distribution including a lcoal high-temperature portion located at a central area or section of a stream of exhaust gases. The exhaust gases then flow out from the outlet end portion 15*a* of the tail pipe 15 into the flared pipe 22 and directly impinge against the central wall portion 24*b* of the buffer plate 24, as indicated by the arrow (4). Upon impingement on the central wall portion 24*b*, the exhaust gases become agitated or turbulent, making the temperature distribution of the exhaust gases uniform which is free from the local high-temperature section. The exhaust gases with uniform temperature distribution spread radially outwardly toward the through-holes 25 and pass through the through-holes 25 in the buffer plate 24, as indicated by the arrows (5).

After passing through the buffer plate 24, the exhaust gases flow through the wire screen 26 during which time sparks in the exhaust gases are arrested or caught by the wire screen 26.

After passing through the wire screen 26, the exhaust gases partly flow downstream along an inside surface of the guide tube 28, as indicated by the arrows (6). This portion of the exhaust gases, as it flows out from an outlet end of the guide tube 28, becomes turbulent, generating retention turbulent flows or swirls, as indicated by the arrows (7). Since the through-holes 25 arranged closer to the outer edge portion 24*a* than to the center of the buffer plate 24 increases a proportion of the exhaust gases flowing along the inside surface of the guide tube 28, the retention swirls have a power strong enough to take in cool atmospheric air which is effective to rapidly cooling down the hot exhaust gases as they are released from the guide tube 28.

Figure 5:
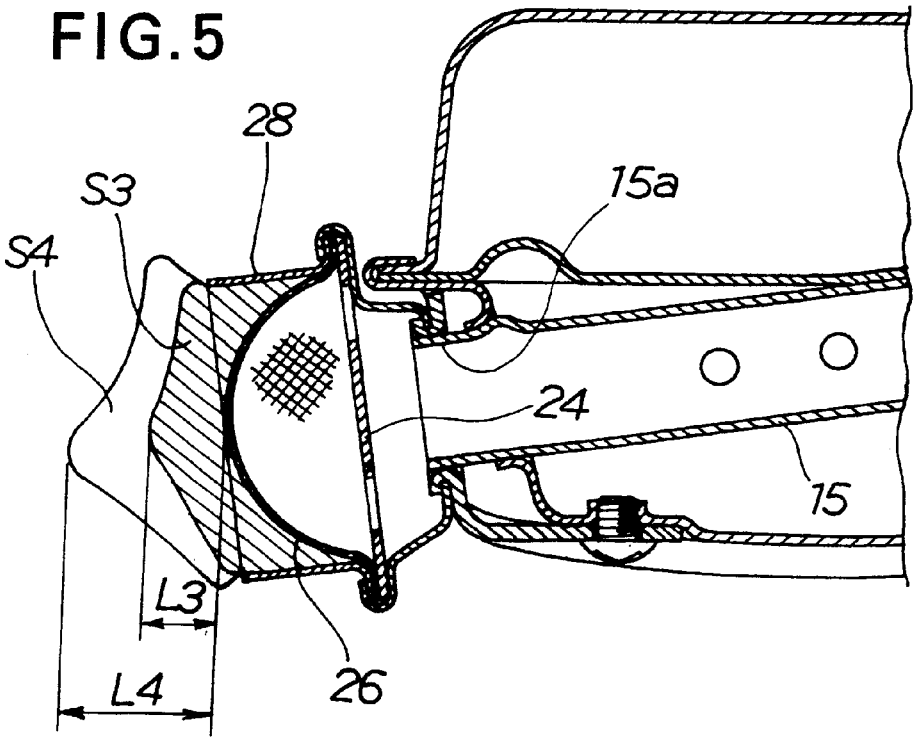
FIG. 5 is a view similar to FIG. 4, showing a temperature distribution of the exhaust gases discharged from the muffler via the spark arrester.

FIG. 5 illustrates a temperature distribution of the exhaust gases being discharged from the guide tube 28. In this figure, an inner part or section S3 indicated by hatching for clarity represents a relatively high-temperature area of the exhaust gases, and an outer part or section S4 represents a relatively low-temperature area of the exhaust gases which is slightly lower in temperature than the high-temperature inner section S3.

Figure 6:
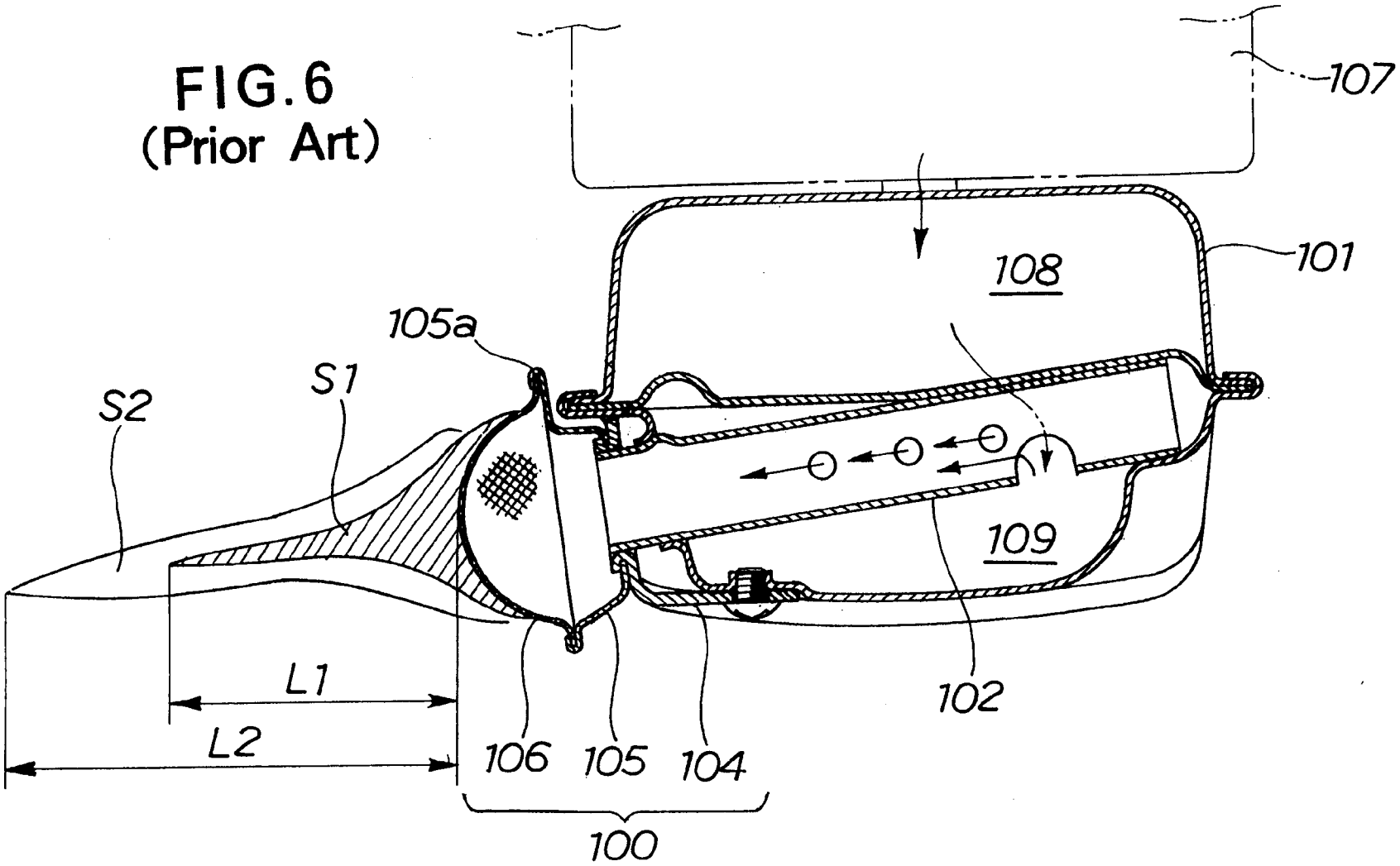
FIG. 6 (Prior Art)
FIG. 6 is a cross-sectional view of a conventional spark arrester.

According to the spark arrester 20 of the present invention, the length L3 of the high-temperature inner section S3 is less than about one fifth of the length L1 of the high-temperature inner section S1 in the case of the convention spark arrester 100 shown in FIG. 6. This is partly because the exhaust gases discharged from the tail pipe 15 are released from the wire screen 26 not directly but after spreading radially and outwardly upon impingement on the buffer plate 24, and partly because the exhaust gases after passing through the wire screen 26 are rapidly cooled down by the action of the retention swirls formed at the outlet end of the guide tube 28. For similar reasons, the length L4 of the relatively low-temperature outer section S4 is less than about one quarter of the length L2 of the relatively low-temperature outer section S2 in the case of the conventional spark arrester 100 shown in FIG. 6. It may be appreciated that the engine 1 having the spark arrester 20 of the present invention attached to the muffler 3 is particularly advantageous when used in a portable working machine, such as a weeding machine or a chain saw because a stream of hot exhaust gases discharged from the guide tube 28 has only a limited length and hence does not affect or damage any of surroundings of the working machine including the operator.

In the embodiment described above, the buffer plate 24 of the spark arrester 20 is disposed upstream of the wire screen 26. The same advantageous effects can also be attained by a modified arrangement (not shown) in which the buffer plate 24 is disposed downstream of the wire screen 26, and the guide tube 28 is disposed downstream of the buffer plate 24. According to the modified arrangement, exhaust gases discharged from the outlet end portion 15*a* of the tail pipe 15 flow through the wire screen 26 during which time sparks in the exhaust gases are caught by the wire screen 26. The exhaust gases then impinge against the central wall portion 24*b* of the buffer plate 24 whereupon they become turbulent or agitated. As a result of this agitation, the hot exhaust gases are made to have a uniform temperature distribution free from a local high-temperature section. The exhaust gases pass through the through-holes 25 in the buffer plate 24, flow downstream along the guide tube 28, and are released from an outlet end of the guide tube 28 into the atmosphere.

In the illustrated embodiment, the wire screen 26 has a dome-like shape projecting in a direction of flow of the exhaust gases. The shape and configuration of the wire screen should by no means be limited to the one in the illustrated embodiment but may include a simple flat plate-like configuration.

Obviously, various minor changes and modifications are possible in the light of the above teaching. It is to be understood that within the scope of the appended claims the present invention may be practiced otherwise than as specifically described.

What is claimed is:

1. A spark arrester attachable to an outlet end portion of a tail pipe of a muffler, said tail pipe having a stream of exhaust gases passing therethrough comprising:

a buffer plate having a central wall portion against which the stream of exhaust gases impinges and having a plurality of through-holes arranged around said central wall portion to allow said stream of exhaust gases after impinging against said central wall portion to be discharged therethrough; and a wire screen for catching sparks in the stream of exhaust gases.

2. A spark arrester according to claim 1, wherein said central wall portion is circular having a diameter at least equal to an inside diameter of the outlet end portion of the tail pipe and arranged in confrontation with the outlet end of the tail pipe to ensure that the exhaust gases discharged from the outlet end of the tail pipe directly impinge against said central wall portion.

3. A spark arrester according to claim 1, wherein said through-holes are arranged along an outer edge portion of said buffer plate.

4. A spark arrester according to claim 1, wherein said through-holes have a total area at least equal to an area of the outlet end of the tail pipe.

5. A spark arrester according to claim 1, wherein said buffer plate is disposed upstream of said wire screen.

6. A spark arrester according to claim 1, further including a guide tube for guiding and releasing the exhaust gases into the atmosphere.

7. A spark arrester according to claim 6, wherein said central wall portion is circular having a diameter at least equal to an inside diameter of the outlet end portion of the tail pipe and arranged in confrontation with the outlet end of the tail pipe to ensure that the exhaust gases discharged from the outlet end of the tail pipe directly impinge against said central wall portion.

8. A spark arrester according to claim 6, wherein said through-holes are arranged along an outer edge portion of said buffer plate.

9. A spark arrester according to claim 6, wherein said through-holes have a total area at least equal to an area of the outlet end of the tail pipe.

10. A spark arrester according to claim 6, wherein said buffer plate is disposed upstream of said wide screen.

11. A spark arrester according to claim 6, wherein said guide tube is disposed downstream of said wire screen.

12. A spark arrester for a tail pipe which discharges exhaust gases, comprising:

a buffer plate having a plurality of through-holes arranged to allow the exhaust gases to pass through said through-holes after the exhaust gases impinge against said buffer plate;

a wire screen for catching sparks in the exhaust gases; and means for attaching said buffer plate and said screen to said tail pipe.

* * * * *